United States Patent [19]

Yamaguchi et al.

[11] Patent Number: 4,614,286

[45] Date of Patent: Sep. 30, 1986

[54] TONER CONTAINER UNIT

[75] Inventors: Keisuke Yamaguchi, Tokyo; Eturo Ochiai, Sagamihara, both of Japan

[73] Assignee: Konishiroku Photo Industry Co., Ltd., Tokyo, Japan

[21] Appl. No.: 508,093

[22] Filed: Jun. 27, 1983

[30] Foreign Application Priority Data

Jul. 2, 1982 [JP] Japan ..... 57-100993[U]

[51] Int. Cl.[4] ..... B65D 25/38

[52] U.S. Cl. ..... 222/505; 222/541; 222/544; 222/559; 222/DIG. 1; 220/350

[58] Field of Search ..... 222/542, 541, 559–561, 222/505, 544–545, DIG. 1; 220/350, 345

[56] References Cited

U.S. PATENT DOCUMENTS

| | | | |
|---|---|---|---|
| 3,631,812 | 1/1972 | Winslow, Jr. | 222/505 X |
| 3,921,190 | 11/1975 | Ell et al. | 222/541 X |
| 3,999,654 | 12/1976 | Pollack | 222/542 X |
| 4,062,385 | 12/1977 | Katusha et al. | 222/544 X |

FOREIGN PATENT DOCUMENTS

| | | | |
|---|---|---|---|
| 749741 | 7/1980 | U.S.S.R. | 222/505 |

*Primary Examiner*—Charles A. Marmor

*Attorney, Agent, or Firm*—James E. Nilles

[57] ABSTRACT

A toner container unit wherein an opening part of the toner container unit is sealed by a film-like sheet surrounding a sliding cover. When the sliding cover slides forwardly the film-like sheet is torn off from the opening part of the toner container unit. When the sliding cover slides backwards the film sheet seals again the opening part.

1 Claim, 5 Drawing Figures

TONER CONTAINER UNIT

BACKGROUND OF THE INVENTION

1. Field of the Invention

This invention relates to a toner container unit for supplying toner to an electrostatic recording means in, for example, an electrophotographic reproducing machine, in which electrostatic images are developed by the toner into visible images and, more particularly, to an improvement in a toner container unit sealed by a film-like seal member.

2. Description of the Prior Art

Generally, in a dry electrostatic recording means employed a two-component developer or a one-component developer, a certain amount of toner is consumed every time a copy is obtained, therefore it is necessary to supply additional toner after a number of copies have been obtained. The supply of toner is is usually carried out by feeding toner from a toner container unit into a developer receiving means, such as a hopper, in the electrostatic recording means.

The toner is usually in the form of a powder in which the average diameter of the toner particles is between ten and twenty microns. Therefore, the toner can scatter very easily. In particular, when the container is tilted or vibrated, the toner can form a suspended fog in the container.

Accordingly, the toner container unit must have a structure that can prevent positively the suspended toner within the unit from escaping through the opening of the container unit. Further, it is also desirable that the opening of the container unit should have a simple opening structure, so that the opening and closing operation can be attained easily.

In view of these requirements, various kinds of toner container units have been suggested.

One of the toner container units of this kind is a type wherein the opening part is sealed by a film-like sheet which is peeled off after the toner container unit is mounted in the hopper, so that the toner in the unit is fed into the hopper.

A typical structure of this type of toner container unit is disclosed in Japanese Utility Model Laid-Open No. 28,447/1979. According to the disclosed device, the opening part of a container containing additional toner is sealed by a film-like sheet whose rear end is turned back. When the toner container has been mounted in the hopper of the reproducing machine, the extension of the turned-back part of the film-like sheet is pulled by hand so as to peel the sheet off from the container unit, so that the toner therein can be fed into the hopper as required.

Another typical structure of toner container unit is disclosed in Japanese Utility Model Laid-Open No. 99,545/1980, in which the opening part of the toner container unit is also sealed by a filmlike sheet which is turned back at the rear end. In this device, the extension of the turned-back part of the sheet is secured to one end of the hopper of the reproducing machine. During the process of inserting the toner container unit into the hopper, the sheet peels off by itself, so that the toner can pass through the exposed opening part.

All of these toner container units described above have a common point in that the opening part is sealed by a film-like sheet. This sealing can provide a good sealing effect so long as the toner is within a sealed container. However, once the opening part is exposed by peeling off the film-like sheet in order to supply the toner to the hopper, or by removing the toner container unit from the hopper in order to replace it with a new one, toner attached to the sheet and opening part of the toner container unit or remaining in the unit can easily be scattered into the surroundings of the reproducing machine and onto the body of the operator.

SUMMARY OF THE INVENTION

This invention has been suggested by the defects inherent in prior art toner container units, therefore it is the object of this invention to provide a toner container unit which ensures a positive and easy toner-supplying operation without dirtying the surroundings of the reproducing machine, as well as the hands and clothes of the operator.

Thus the invention is designed to achieve the above object, and therefore this invention provides a toner container unit having a film-like sheet sealing the opening part of the toner container unit, with a sliding cover provided over the film-like sheet, characterized in that the film-like sheet is turned back at the rear end thereof and is attached to the opening at a position on the side opposite to the rear end of the sheet extending over the outside of the sliding cover.

In more detail, the toner container unit according to this invention has a structure in which the opening part of the toner-containing container is sealed by a film-like sheet, a sliding cover is provided outside the sheet for reinforcement and opening purposes, the sliding cover being able to slide in engagement with the opening part of the container unit, and an extension of the film-like sheet is turned back and extends outside the sliding cover, so that the front and rear ends of the film-like sheet are both attached to the opening at a position in the vicinity of the front end.

In order to supply toner using the thus-constructed toner container unit, the toner container unit is mounted in the hopper of the reproducing machine with the opening part thereof positioned downward, and the sliding cover is slid in the direction from the rear end toward the front end of the sealed part, thereby peeling off the sealing of the sheet gradually to expose the opening part, so that the toner can drop down into the hopper through the exposed opening part.

When the toner supply is finished, the sliding cover is slid back to its starting position. This also returns the peeled sheet to its starting position. This cooperation of the sliding cover and sheet provides a complete closing of the opening part of the container. Finally, the toner container unit, now empty, is removed from the reproducing machine.

As can be clearly understood from the foregoing description, the toner container unit of this invention prevents the scattering of the toner not only during the toner-supplying operation but also when removing the toner container unit. As a consequence, the structure of the toner container unit has advantages from the point of view of the maintenance of the reproducing machine, the cleaning thereof, and working efficiency.

Since the film-like sheet in this invention is adapted to peel back and return with the sliding motion of the sliding cover, the sheet is free from such inconveniences as bending, twisting and breaking.

The other objects and advantages of this invention will be described in detail with reference to the accompanying drawings.

DESCRIPTION OF THE PREFERRED EMBODIMENTS

Figure 1:
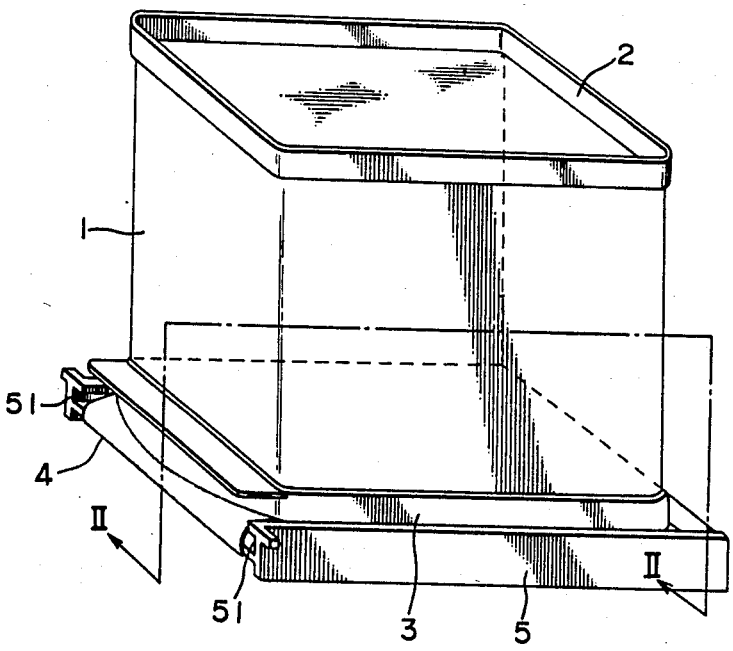
FIG. 1, FIG. 3 and FIG. 5 are perspective views of the toner container unit according to this invention.
Figure 2:
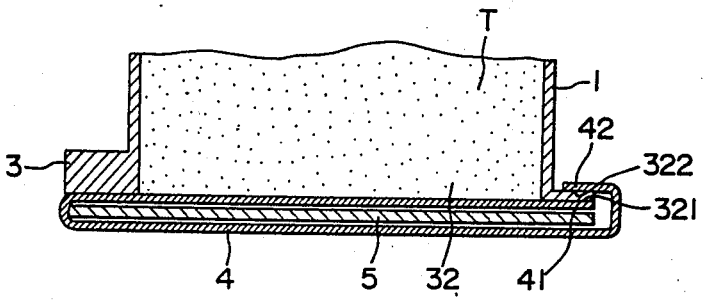
FIG. 2 and FIG. 4 are sections thereof.

FIG. 1 is a perspective view of the toner container unit according to this invention, in which the opening part of the toner container unit is sealed by a film-like sheet. FIG. 2 is a section taken along the line II—II of FIG. 1.

Numeral 1 denotes a container body, which is substantially cylindrical and has at least one end open. The container body 1 could be made of metal, plastic or paper, but is most appropriately made of cardboard of a relatively large thickness, which is coated with a resin or laminated with polyethylene, nylon or aluminum foil to improve the moisture-resisting characteristics of the cardboard.

Numeral 2 denotes a fixed cover which could be made of metal, plastic or paper, but which could also be made by molding a plastic of the ABS type. The fixed cover 2 and the container body 1 may be formed as an integral unit by plastic molding techniques.

Numeral 3 denotes a cover unit around the open end of the container body 1, which could be made of metal or plastic. A molding of ABS type plastic could also be employed. If the container body 1 is made of plastic, the cover unit 3 can also be made of plastic in an integral unit with the container body 1. The cover unit 3 has projections 31 (shown in FIG. 3) extending laterally in a sliding direction, the projections 31 engaging with a sliding part of a sliding cover 5 which will be described later.

Numeral 4 denotes a film-like sheet for sealing an opening 32 surrounded by the cover unit 3. This film-like sheet 4 is attached by means of, for example, an adhesive to the periphery of the opening 32 and along a lower end surface 33 of the cover unit 3. This film-like sheet 4 can be peeled off from the position in which it is attached. The attachment of the film-like sheet 4 to the cover unit 3 can also be obtained by a heat sealing method or a pressure method.

The film-like sheet 4 is attached firmly at a front end 41 thereof to a front-end attachment 321 in the vicinity of one end of the opening 32. The sheet 4 then extends from the attachment point along the lower end surface 33 of the cover unit 3 and is attached thereto. In this instance, the sheet 4 can be peeled off and re-attached. The sheet 4, now extending toward the rear end of the cover unit 3, is turned back from the sealed end in the vicinity of the other end of the opening 32. The extended part then goes over the outside of the sliding cover 5 and is finally attached by adhesive at the rear end 42 to a rear-end attachment 322 on the upper surface of the cover unit 3 in the vicinity of the front-end attachment 321.

The following materials are suitable for the film-like sheet 4 because they are flexible and strong enough against breaking: polyester film, laminations of polyethylene and polyester, laminations of polypropylene and polyester and laminations of polyethylene or polypropylene on aluminum foil.

Numeral 5 denotes a sliding cover preferably made of metal or plastic, which is provided to protect the film-like sheet 4 during the storage and transportation of toner and to open the container when supplying the toner. This sliding cover 5 is provided with sliding grooves 51 which engage with the projections 31 on the cover unit 3. As can be seen clearly in FIG. 2, which shows a cross-section of the toner container unit of FIG. 1, the toner contained within the container body 1 is supported both by the film-like sheet 4 and the sliding cover 5 during the storage and transportation thereof.

Figure 3:
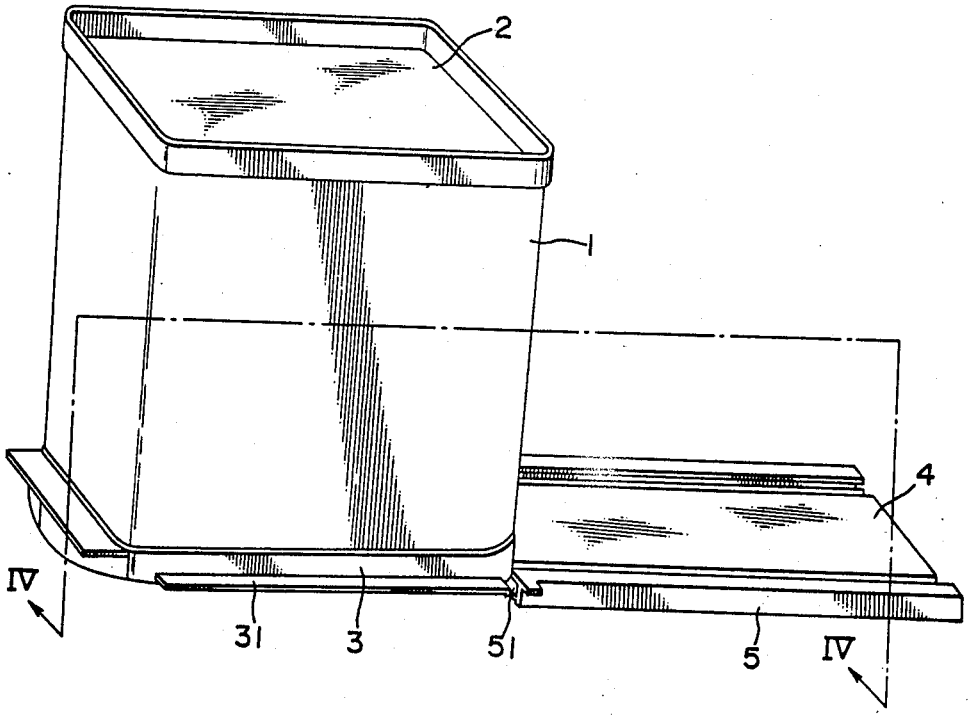
Figure 4:
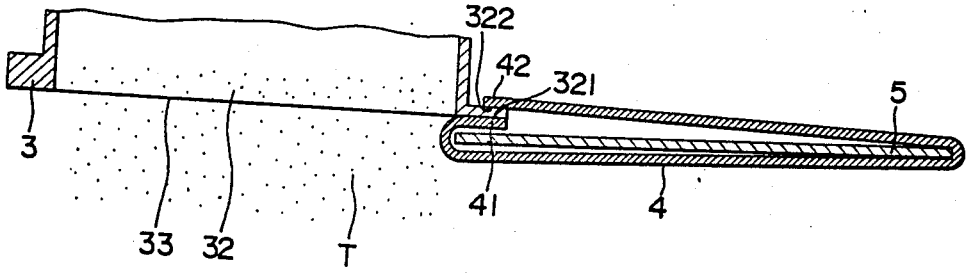
Figure 5:
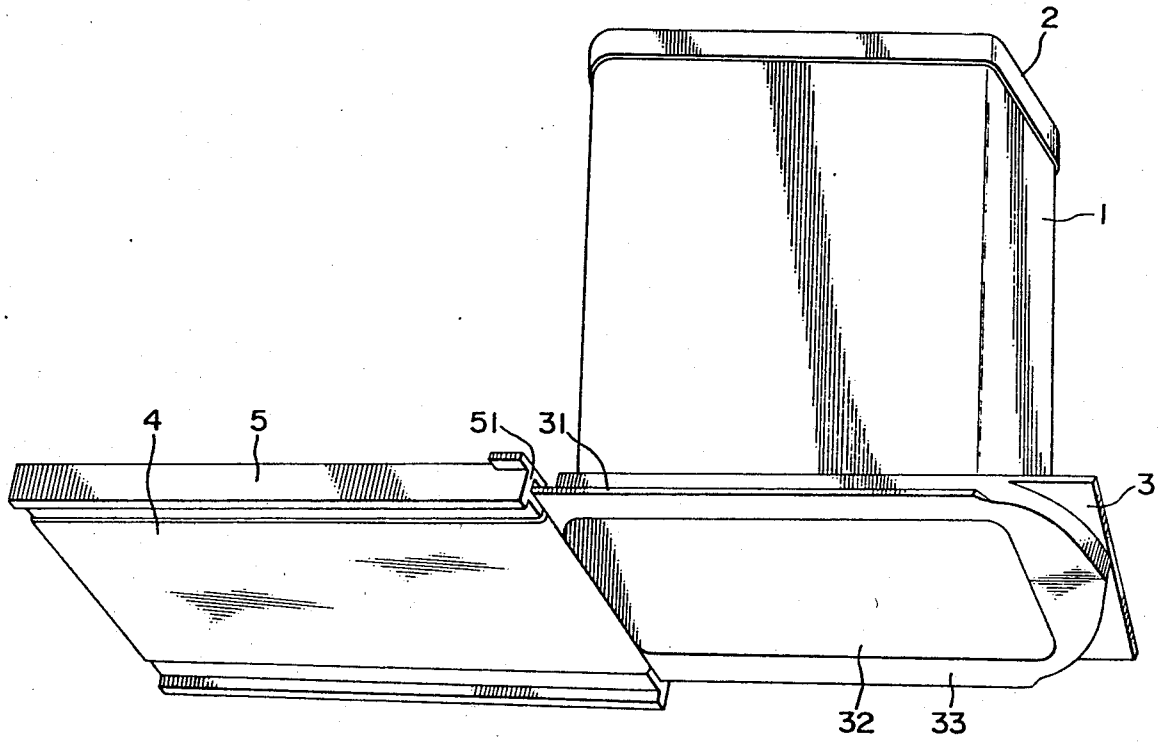

FIG. 3 is a perspective view of the toner container unit supplying toner, and FIG. 4 is a cross-section taken along the line IV—IV of FIG. 3. FIG. 5 is a perspective view of this from below.

In the toner-supplying operation as shown in FIGS. 3 through 5, when the sliding cover 5 is pulled toward the attachment 321 (or 322), that is, to the right in the drawing, the film-like sheet 4 is also pulled together with the sliding cover 5, and is peeled off from the opposite end to the attachment 321 or 322 of the lower end surface of the opening 32. When the sliding cover 5 is at its furthest position in the rightward direction, the opening 32 is substantially completely open, and the toner T within the container body 1 can drop down easily and completely through thus-opened opening 32.

When the toner supply is finished, the sliding cover 5 is slid to the left in the drawing to return to its starting position. Together with this returning motion of the sliding cover 5, the film-like sheet 4 also returns to its starting position as shown in FIG. 1, thereby covering again the opening 32 as it was before the toner-supplying operation. Then the toner container unit can be removed from the hopper of the reproducing machine.

It must be noted here that this invention allows for some modification to, for example, the structure of the film-like sheet 4 and the sliding cover 5. In more detail, in the film-like sheet 4 as described in the foregoing and illustrated in the drawings, the front end 41 is attached firmly to the frontend attachment 321. However, if a stopper or other suitable member is provided to limit the distance that the sliding cover 5 slides, it is not always necessary to attach the front end 41 of the film-like sheet 4 as in the illustrated embodiment. That is, it is sufficient to attach only the rear end 42 of the film-like sheet 4 to the rear-end attachment 322. Such a modification is well within the scope of the spirit and techniques of this invention.

Finally, some important advantages of the toner container unit according to this invention will be listed as follows:

(1) Because the container body is completely sealed by means of the film-like sheet, the toner within the container body is also sealed up. Further, the film-like sheet is protected by the sliding cover, and therefore the toner is protected very safely during storage and transportation.

(2) The toner-supplying operation is only carried out by engaging the toner container unit with the hopper and sliding aside the sliding cover. This operation is very simple, smooth and accurate.

(3) Because the rear end 42 of the film-like sheet 4 is attached and fixed to the rear-end attachment 322 of the cover unit 3, it is sufficient to make the sliding stroke of the sliding cover when peeling off the film-like sheet as long as the sealing part of the cover unit. This length is much shorter than in the prior art devices.

(4) When the sliding cover is returned to its starting position, the film-like sheet is also returned to its starting position, with the inner surface with toner attached housed within the container body. Thus the toner never scatters into the surroundings of the machine, thereby removing the need for cleaning. As a result of this the working efficiency is improved markedly.

(5) Toner pollution does not occur during the whole process of toner supply.

What is claimed is:

1. A toner container unit for detachable mounting on an electrostatic recording means comprising:

a toner container body having an opening therein and having a surface around the periphery of said opening;

a sliding cover having an inside surface, an outside surface, and opposite ends and slidably mounted on said container body for movement between closed and open positions relative to said opening;

a film-like sheet having opposite ends and disposed around the opposite ends of said cover so as to extend over the outside surface and at least a portion of the inside surface of said cover, both ends of said sheet being fixedly secured to said container body near a side of said opening, said sheet being movable by said cover;

and adhesive means between said sheet and said container body for initially adhesively and detachably securing that portion of said sheet between said body and said inside surface of said cover to said surface around said opening to seal said opening when said cover initially is in closed position;

said cover being slidably movable initially from closed to open position to move said sheet and to peel said portion of said sheet from said surface to which it is adhesively and releasably secured to unseal said opening, said cover being slidably movable from open to closed position to move said sheet and to reclose said opening.

* * * * *